US005579681A

United States Patent [19]

Ubert et al.

[11] Patent Number: 5,579,681

[45] Date of Patent: Dec. 3, 1996

[54] BASKET GUIDE FOR A HOT AIR OVEN

[75] Inventors: Harald Ubert, Raesfeld; Joachim Barthel, Reken, both of Germany

[73] Assignee: Ubert Gastrotechnik G.m.b.H., Raesfeld, Germany

[21] Appl. No.: 541,406

[22] Filed: Oct. 10, 1995

[30] Foreign Application Priority Data

Oct. 10, 1994 [DE] Germany ..... 44 36 037.1

[51] Int. Cl.[6] ..... A47J 37/04; A47J 43/18; F24C 7/00; F24C 15/16

[52] U.S. Cl. ..... 99/427; 99/330; 99/357; 99/443 R; 99/450; 99/476; 126/21 A; 219/389; 219/400

[58] Field of Search ..... 99/327–330, 323.5, 99/403–410, 357, 426, 427, 476, 348, 447–450, 443 R, 443 C, 483; 126/21 A; 34/186; 219/400, 389, 388, 506, 438; 426/232, 520, 523

[56] References Cited

U.S. PATENT DOCUMENTS

| | | | |
|---|---|---|---|
| 4,155,294 | 5/1979 | Langhammer | 99/427 |
| 4,295,419 | 10/1981 | Langhammer | 99/427 |
| 4,374,318 | 2/1983 | Gilliom | 219/400 |
| 4,491,065 | 1/1985 | Poulson | 99/327 |
| 5,097,754 | 3/1992 | Covington et al. | 99/357 |
| 5,134,927 | 8/1992 | McCarthy, III et al. | 126/21 A |
| 5,148,737 | 9/1992 | Poulson | 99/450 X |
| 5,154,940 | 10/1992 | Budzyna et al. | 426/232 |
| 5,193,444 | 3/1993 | Bar-Sheshet | 99/427 |
| 5,203,253 | 4/1993 | Covington et al. | 99/476 X |
| 5,275,092 | 1/1994 | Fauteux | 99/407 |
| 5,285,719 | 2/1994 | McFadden et al. | 219/400 X |
| 5,339,726 | 8/1994 | Poulson | 99/427 X |
| 5,419,239 | 5/1995 | Covington et al. | 99/357 |
| 5,445,073 | 8/1995 | Gilwood | 99/427 |

FOREIGN PATENT DOCUMENTS

| | | |
|---|---|---|
| 0247957A2 | 12/1987 | European Pat. Off. . |
| 1578666 | 8/1969 | France . |
| 621768 | 7/1934 | Germany . |
| 6609900 | 11/1972 | Germany . |
| 3314913 | 11/1983 | Germany . |
| 3544582A1 | 6/1987 | Germany . |
| 3931217A1 | 4/1990 | Germany . |
| 9201451 U | 6/1992 | Germany . |
| WO93-18349A1 | 9/1993 | WIPO . |

*Primary Examiner*—Timothy F. Simone
*Attorney, Agent, or Firm*—Milton Oliver

[57] ABSTRACT

The invention relates to a hot air oven for the preparation of foodstuffs with a housing, with a cooking chamber delimited by four side walls as well as a bottom and a ceiling, with a first (2) blower for generating a hot air flow in the cooking chamber, with a rotatable basket (4) for the foodstuffs (5), which can be inserted into the cooking chamber, wherein the basket (4) can be rotated around an axis of rotation and the hot air stream flows through it during operation, wherein the basket (4)is guided into the direction required for insertion into the cooking chamber by means of guide elements (10) wherein the guide elements (10) are provided with a friction-reducing surface.

15 Claims, 2 Drawing Sheets

BASKET GUIDE FOR A HOT AIR OVEN

FIELD OF THE INVENTION

The instant invention relates to a hot air oven for the preparation of foodstuffs.

BACKGROUND

Such a hot air oven is known, for example, from U.S. Pat. Nos. 4,155,294 and 4,295,419, LANG HAMMER.

A basket is disposed, rotatable around a horizontal axis, in a cooking chamber of a hot air oven for cooking foodstuffs. Air is recirculated in the cooking chamber of the hot air oven and in the course of recirculation is heated to a set temperature by a heater. The foodstuffs in the basket are continuously turned and moved during the preparation phase so that the hot air, which causes the cooking and frying of the foodstuffs, can reach the foodstuffs essentially at all surface points.

With the known hot air oven, a wire basket with a rectangular cross section is to be inserted into the hot air oven, wherein the basket is to be guided between four angled rails, which represent the guide-elements for the basket. The four angled rails are arranged in such a way that they enclose the corners of the square cross section of the wire basket toward the outside.

Disadvantages crop up in the use of the known hot air oven. Normally the basket as well as the guides are made of stainless steel, so that considerable frictional forces must be overcome when inserting and removing the basket. Furthermore, when becoming soiled, a considerable increase in the frictional resistance must be expected because of the large relative contact surfaces between the basket and the guides. At times jamming occurs between the basket and the guides, which is encouraged by the thermal warping of the structural elements. Finally, it is possible that material is abraded by the relative movement between the basket and the guides made of the same material, which is undesirable in foodstuffs.

SUMMARY OF THE INVENTION

It is therefore the object of the invention to create a hot air oven wherein the guidance of the basket for preparing foodstuffs is designed with fewer problems.

Because the guide elements are provided with a friction-reducing surface, the basket is more easily movable in its guide in every case. Such coating also leads to little or no abrasion at all in the course of the movement of the basket in its guide.

If the guide elements are disposed parallel with the axis of rotation of the basket, they occupy only a small portion of the exterior circumferential surface of the basket, which should be as large as possible for aeration during preparation. The guide elements are also provided with the required rigidity if they are essentially made of metal.

The guide elements are preferably round in cross section, so that they form the smallest possible contact surface with the basket. The smaller the contact surface, the smaller (with constant frictional resistance) the force to be overcome for inserting and removing the basket.

Particularly good functioning is achieved if the guide elements are coated or enclosed with a plastic material in the area which is in contact with the basket. There is no hazard to health here in enclosing the guide elements in polytetrafluoroethylene.

Good basket guidance, which in addition permits a basket shape which offers advantages in the preparation of foodstuffs in the operation, is provided, if the basket is approximately square in cross section, wherein the corners are rounded off, if in addition the guide elements are formed by rods or pipes, and if the areas of the basket which immediately follow adjoining corners are concave, viewed from the outside.

This is also aided if two corners located opposite the concave areas are convex.

The basket is fixed against relative rotation by two guide elements if the radius of curvature of the concave areas approximately corresponds to the radius of the guide elements, and if the guide elements in addition fix the basket in place between themselves in a radial direction in respect to the axis of rotation of the basket.

It is advantageous for the rotary drive of the basket, if the guide elements are disposed with one side on a base plate, and the base plate is provided with the drive. In this case the base plate should be rotatable around an axis which is oriented perpendicularly on the base plate and which rotationally drives the basket when it has been inserted between the guide elements.

BRIEF FIGURE DESCRIPTION

FIGS. 1 shows hot air oven in accordance with the invention in the direction toward the axis of rotation of the basket in a cross section; and FIG. 2, is an enlarged representation of the upper left basket guide in FIG. 1.

DETAILED DESCRIPTION

Figure 1:
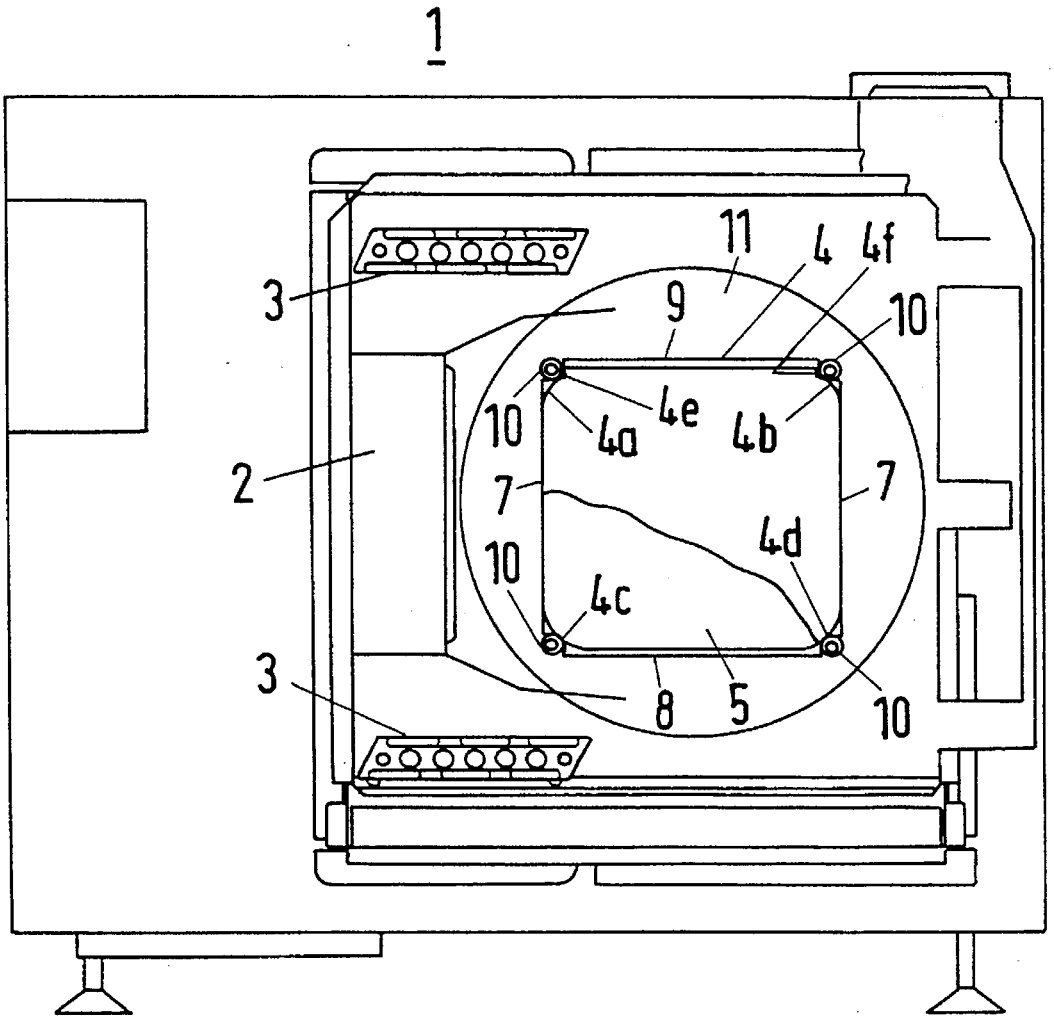

FIG. 1 shows a hot air oven 1 with a hot air blower 2, which conveys an air flow over heaters 3 to a basket 4. During operation, frozen foodstuffs 5, for example French fries, are filled into the basket 4. It is necessary for an even preparation of the foodstuff 5 that the foodstuff 5 is continuously turned over and moved. For this purpose the basket 4 is rotatably arranged around an axis which is approximately in the center of the basket 4 and is oriented perpendicular to the plane of the drawing The exterior shape of the basket 4 is approximately cuboid with an almost square cross section crosswise to its long sides. The long sides are not represented in FIG. 1, they extend in the viewing direction. The edges extending parallel with the long sides are visible in FIG. 1 as corners 4*a*, 4*b*, 4*c* and 4*d* of the basket 4. The corners 4*a*, 4*b*, 4*c* and 4*d* are rounded off with a radius of approximately 30 mm, which is advantageous for the preparation of French fries, since breaking of the French fries is prevented as much as possible even in the not yet fried, but already thawed state. However, the corners can also be flattened at an angle of 45° in respect to the long sides, which is advantageous from the viewpoint of production techniques.

The two essentially square front ends 6 of the basket 4 are made of a continuous sheet metal piece, while the two long side walls 7 and the bottom 8 are made of a mesh which permits the flow-through of hot air through the basket 4. The basket 4 is open at the top for filling it with foodstuffs 5, but is closed off by a mesh 8 in its state where it is inserted into the hot air oven 1. The opening at 9 is surrounded by a chute-like collar which is formed, starting at the corners 4*a* and 4*b*, with a curvature opposite the rounding of the corner. This curvature constitutes a hollow throat 4*e* and 4*f* adjoining the corners 4*a* and 4*b* as well as the opening and has a curvature in the shape of a circle.

The side walls 7 and the bottom 8 can be advantageously made in one piece of a sheet metal section, from which first the areas which are intended to form the free surface of the mesh have been stamped out. Then the sheet metal piece can be bent in such a way that the cross section in accordance with FIG. 1 is created, wherein the corners can be rounded with the required radius. If now the closed sheet metal pieces are welded to the jacket-like mesh to form the front ends 6, the shape of the basket 4 already corresponds to a large extent to the basket 4 represented in FIG. 1. A section projecting past the rear end of the basket 4 extends the basket 4 toward the back past the volume intended for the foodstuff 5. This section extends the long sides of the basket 4 and in this way improves its guidance in the hot air oven 1.

For filling and emptying, the basket 4 can be pulled out of the hot air oven 1 linearly toward the viewer in FIG. 1. For this purpose the basket 4 is seated in a basket guide which essentially comprises four rod- or pipe-like guide elements 10. The guide elements 10 are disposed in the area of the corners 4*a* to 4*d* parallel with the long edges of the basket.

The guide elements 10 rest in the area of the corners 4*c* and 4*d* on the outside of the latter against the basket with a linear contact and merely fix it in place in a radially outward direction. However, in the area of the corners 4*a* and 4*b*, the guide elements rest in the hollow throats 4*e* and 4*f*, which have for this purpose a radius of curvature corresponding to the radius of the guide elements 10. By means of this contact the basket 4 is not only fixed in place in a radial direction toward the outside in the area of the corners 4*a* and 4*b* (as in the corners 4*c* and 4*d*), but is also essentially fixed against relative rotation.

Figure 2:
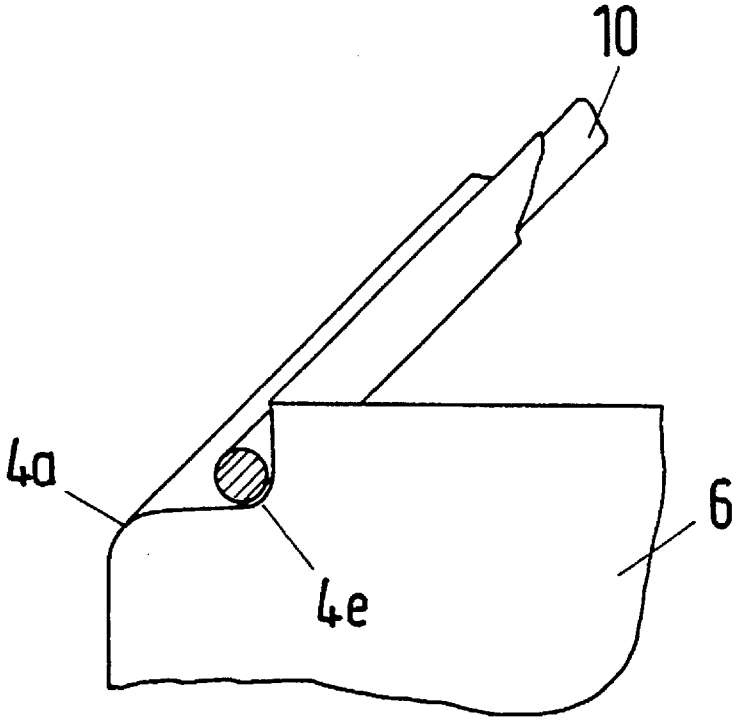

The shape of the corners 4*a* and 4*b* is represented by the example of the corner 4*a* in FIG. 2.

The guide elements 10 are arranged on a support plate 11 and extend perpendicularly in respect to its surface. Thus the support plate 11 is parallel in respect to the front end 6 when the basket 4 is inserted into the hot air oven 1.

The support plate 11 is driven by a motor (not shown) to rotate around its axis of symmetry, which coincides with the long axis of the basket 4. In the course of its rotation it takes the basket 4 along and in this way provides the turnover of the foodstuff contained therein.

During operation the basket 4 is first manually pulled out of the hot air oven against a stop, so that the above mentioned section projecting backward past the volume provided for the foodstuff 5 remains inside the device and provides a mounting for the basket 4 in the pulled-out state, too.

Then the desired amount of foodstuff 5, for example frozen French fries, is placed into the basket.

The basket 4 is then pushed into the hot air oven 1. The drive of the support plate then starts to turn it, wherein the guide rods 10 and the basket 4, which is inserted between the guide rods 10 fixed against relative rotation, rotate along with it.

The hot air blower 2 recirculates the air in the hot air oven, wherein the air is heated to the desired set temperature by means of the heaters 3.

This state is maintained until the preparation of the foodstuff 5 is finished.

The heat output of the heater 3 is then reduced, the output of the hot air blower 2 is reduced or it is completely stopped, and the rotation of the basket is halted in a position in which the basket opening is at the top.

Now the basket 4 is again manually pulled out of the hot air oven 1 and as a result of an action of the operator is turned by 360°, in the course of which the foodstuff 5 falls downward out of the basket.

For safety and dependability in the operation of the hot air oven 1 it is provided to attach a sensor for the basket position at a place on the basket guidance. This sensor can then be interrogated by the control of the hot air oven 1 at the start and during the preparation process, so that the startup of the rotary basket drive takes place only when the basket has been completely inserted.

Polytetrafluoroethylene (PTFE, Teflon®) and special steel are suggested as the pair of materials for the contact surfaces between the guide elements 10 and the basket 4. This pairing of materials has low friction and low wear and is heat resistant (at the temperatures around approximately 230° C. considered here). Furthermore these materials are harmless when in contact with the foodstuff during its preparation. For good mechanical rigidity it is suggested to form the guide elements as steel pipes with a PTFE coating.

Other materials are also conceivable and suitable, as long as they have the mentioned properties. However, the above mentioned combination is always preferred for reasons of cost.

In comparison with known basket guides it is advantageous that there will be no tilting of the basket 4 in the guides and that abrasion, which unavoidably occurs in connection with the known material pairing of special steel/special steel, is prevented.

What is claimed is:

1. A hot air oven for the preparation of foodstuffs, with a housing, with a cooking chamber delimited by four side walls as well as a bottom and a ceiling, with a first (2) blower for generating a hot air flow in the cooking chamber, with a rotatable basket (4) for the foodstuffs (5), which can be inserted into the cooking chamber, wherein the basket (4) can be rotated around an axis of rotation and the hot air stream flows through it during operation, wherein the basket (4) is guided into the direction required for insertion into the cooking chamber by means of guide elements (10), characterized in that the guide elements (10) are provided with a friction-reducing surface.

2. A hot air oven in accordance with claim 1, characterized in that the guide elements (10) are disposed parallel with the axis of rotation of the basket (4).

3. A hot air oven in accordance with claim 1, characterized in that the guide elements (10) are essentially made of metal.

4. A hot air oven in accordance with claim 1, characterized in that the guide elements (10) are round in cross section.

5. A hot air oven in accordance with claim 1, characterized in that the guide elements (10) are coated or enclosed in a plastic material at least in the area which is in contact with the basket (4).

6. A hot air oven in accordance with claim 1, characterized in that the guide elements are enclosed in polytetrafluoroethylene.

7. A hot air oven in accordance with claim 1, characterized in that the basket (4) is approximately rectangular in cross section, wherein the corners (4*a*, 4*b*, 4*c*, 4*d*) are rounded or flattened.

8. A hot air oven in accordance with claim 1, characterized in that the guide elements (10) are formed by rods or pipes.

9. A hot air oven in accordance with claim 1, characterized in that two areas (4*e*, 4*f*) of the basket (4), which immediately adjoin neighboring corners (4*a*, 4*b*), are concave, viewed from the outside.

10. A hot air oven in accordance with claim 1, characterized in that two corners (4*c*, 4*d*), located opposite the concave areas (4*e*, 4*f*), are convex.

11. A hot air oven in accordance with claim 1, characterized in that the radius of curvature of the concave areas (4*e*, 4*f*) approximately corresponds to the radius of the guide elements (10).

12. A hot air oven in accordance with claim 1, characterized in that the guide elements (10) fix the basket (4) between themselves in a radial direction in respect to the axis of rotation of the basket (4).

13. A hot air oven in accordance with claim 1, characterized in that the guide elements (10) are disposed on one side of a base plate (11).

14. A hot air oven in accordance with claim 13, characterized in that the base plate (11) is provided with a drive.

15. A hot air oven in accordance with claim 13, characterized in that the base plate (11) is rotatable around an axis oriented perpendicularly on the base plate (11) and rotatingly drives the basket (4) when it is inserted between the guide elements (11).

* * * * *